US005611184A

United States Patent [19]

Felix et al.

[11] Patent Number: 5,611,184

[45] Date of Patent: Mar. 18, 1997

[54] COVERING PANEL

[76] Inventors: André Felix, Route de Berne 25, CH - 1010 Lausanne; Laurent Felix, Chemin des Combes 45, CH - 1802 Corseaux, both of Switzerland

[21] Appl. No.: 507,392

[22] PCT Filed: Dec. 30, 1994

[86] PCT No.: PCT/CH94/00246

§ 371 Date: Aug. 24, 1995

§ 102(e) Date: Aug. 24, 1995

[87] PCT Pub. No.: WO95/18900

PCT Pub. Date: Jul. 13, 1995

[30] Foreign Application Priority Data

Jan. 3, 1994 [FR] France ..... 94 00070

[51] Int. Cl.[6] ..... E04F 13/12; E04C 2/08

[52] U.S. Cl. ..... 52/506.05; 52/522; 52/508; 52/512; 52/478

[58] Field of Search ..... 52/521, 522, 537, 52/539, 506.06, 508, 506.01, 506.08, 506.1, 506.5, 713, 714, 512, 478, 552, 544, 543; 362/147

[56] References Cited

U.S. PATENT DOCUMENTS

| | | | |
|---|---|---|---|
| 3,085,367 | 4/1963 | DeRidder et al. . | |
| 4,063,396 | 12/1977 | Attaway . | |
| 4,081,938 | 4/1978 | Bertacchi et al. | 52/506.06 X |
| 4,334,396 | 6/1982 | Hagopian | 52/521 X |
| 4,450,665 | 5/1984 | Katz | 52/522 |
| 5,201,158 | 4/1993 | Bayley et al. | 52/521 X |
| 5,224,318 | 7/1993 | Kemerer | 52/521 |
| 5,257,409 | 11/1993 | Endo et al. | 52/512 X |
| 5,313,759 | 5/1994 | Chase, III | 52/506.06 |

FOREIGN PATENT DOCUMENTS

| | | | |
|---|---|---|---|
| 1040475 | 10/1958 | Germany | 362/147 |
| 1297836 | 6/1969 | Germany . | |
| 2530912 | 1/1976 | Germany . | |
| 541046 | 10/1973 | Switzerland . | |

*Primary Examiner*—Carl D. Friedman
*Assistant Examiner*—Timothy B. Kang
*Attorney, Agent, or Firm*—Davis and Bujold

[57] ABSTRACT

A covering panel consisting of a metal cladding with a supporting structure (15) and cladding members (11) attached via fastening screw (14). The cladding members (11) consists of extruded aluminum sections and comprise quick fastening members (12) and locking members (13) for interconnecting the sections. The cladding members (11) are joined to the supporting structure (15) by evenly spaced longitudinal T-shaped sections (20) each having an axial longitudinal channel (21) with grooved walls for engagement with the screws (14) for fastening the cladding members. The sections are adjustably spaced from the wall (22) via brackets (23) engageable with the longitudinal sections (20).

11 Claims, 3 Drawing Sheets

COVERING PANEL

FIELD OF THE INVENTION

The present invention concerns a covering panel consisting of a metal cladding comprising a supporting structure, and cladding members consisting of extruded aluminum or synthetic sections, said sections having quick fastening means which form a rigid interconnection between each juxtaposed pair.

Various covering systems using crimped metal panels are known in the art. These panels are positioned and attached using a multitude of screws or rivets, which is a lengthy, detailed operation. Furthermore, such metal panels generally can have only simple shapes, since the crimping process is not conducive to elaborate, creative forms. Finally, the crimped panels cannot be easily connected, as they must be juxtaposed and individually attached to the supporting structures with many screws or rivets. This not only detracts from their appearance, but also makes them poorly adaptable to the architecture of the underlying structure.

BACKGROUND OF THE INVENTION

Covering panels consisting of extruded, laterally interlocking elements have been designed to overcome these practical and aesthetic drawbacks. Such panels are described, for example, in U.S. Pat. Nos. 3,085,367 and 4,063,396, as well as German Patent Application No. DE-A-1 297 836. However, these panels are not particularly easy to attach, since each panel must be individually fastened to a conventional supporting structure, which is a complicated, expensive and unwieldy procedure.

SUMMARY OF THE INVENTION

To overcome these disadvantages, the present invention proposes a facade panel as described above, characterized by having longitudinal sections which are longitudinally or vertically disposed at regular intervals, and further comprising an axial longitudinal channel with interior walls having grooves parallel to the axis, said channels being designed to receive the screws for fastening the cladding members. The screws having a threaded shaft which cooperates with the grooves in the channels of the longitudinal sections.

According to a preferred embodiment, said longitudinal sections are extruded and made of aluminum alloy.

The longitudinal sections are generally T-shaped, with the central portion of the T comprising the axial longitudinal channel and with a spline in the extension of the channel. The transverse portion splits into two lateral flanges respectively situated on either side of the channel.

Said axial longitudinal channel preferably extends along only one side of the top of the central T-shaped portion.

According to a preferred embodiment, said supporting structure also comprises angled brackets, one arm of which has at least one opening for a wall fastening screw, and the other arm o which has an opening which receives at least a portion of the spline of the central T-shaped portion.

In this preferred embodiment, the arm with the opening has a generally cylindrical housing along its entire width, which receives a blocking screw of a longitudinal section when the spline of the central T-shaped portion engages said opening.

The blocking screw is preferably self-boring and the cylindrical housing is preferably divided along its axis.

According to a preferred embodiment, the distance separating the lateral walls of the channel in the longitudinal sections, as measured from the base of the opposing grooves, is generally equal to the dimension of the shaft of the fastening screw measured on the exterior of the screw threads.

According to a particularly advantageous embodiment, said cladding members have openings for concealing lights.

Preferably, said cladding members have both quick assembly means and means for interlocking them in pairs.

BRIEF DESCRIPTION OF THE DRAWINGS

The present invention will be better understood with reference to the description of some exemplary embodiments and to the attached drawings, wherein.

DESCRIPTION OF THE PREFERRED EMBODIMENTS

Figure 1:
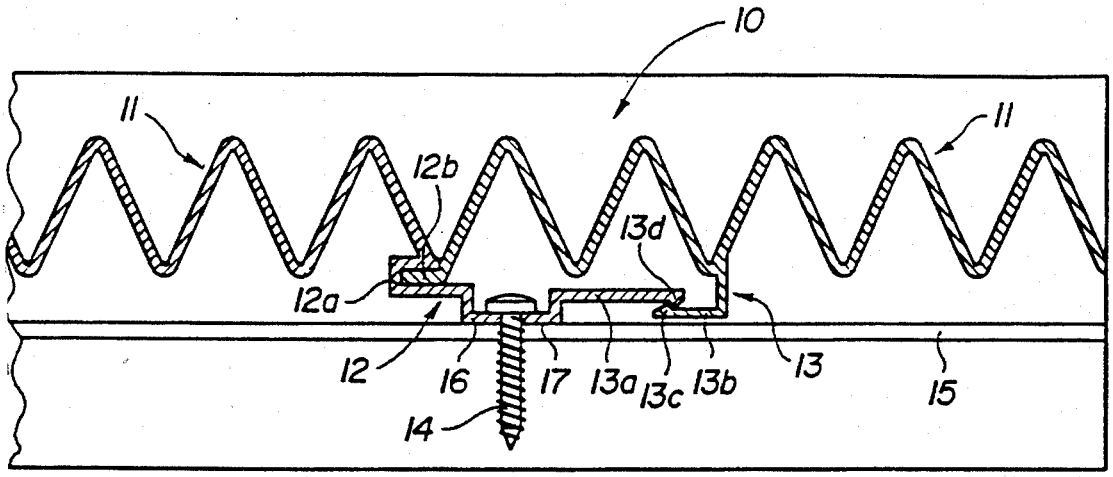
FIG. 1 is a horizontal or front-to-rear cross-section of two cladding members comprising the covering panel according to the invention.

With reference to FIG. 1, covering panel 10 consists of a unit of cladding members 11 in the form of longitudinal panels mounted side by side to form an exterior surface with a uniform appearance. These cladding members are made of aluminum, an aluminum based alloy, or a synthetic material, using a well-known extrusion manufacturing technique.

Because of the extrusion technique, the cladding members have quick assembly means 12 and locking means 13 for connecting them to each other and locking them in position. This reduces considerably the number of screws 14 required to attach the cladding members to a supporting structure 15, which will itself be affixed to the building to be sided. The quick assembly means 12 preferably consists of a slot **12*a* running along one side of each cladding member 11 and of a rim 12*b* running along the other side of each cladding member 11. Slot 12*a* and rim 12*b* are shaped so that the rim 12*b* of a first cladding member 11 engages slot 12*a* of another cladding member 11 which is adjacent the first cladding member. They interlock in such a way that from the outside, two cladding members 11** placed together appear to have a continuous, unbroken surface.

The locking means advantageously consists of two legs **13*a* and 13*b* on the rear surface of cladding member 11, with two tips 13*d* and 13*c*, respectively, which are somewhat flexible. Leg 13*a* with its tip 13*d* extends from one of the walls defining slot 12*a* and is located along the side of cladding element 11 which has the slot. Leg 13*b* and corresponding tip 13*c* are located on the rear surface of cladding element 1 near the edge with rim 12*b*. Therefore, the extremities of legs 13*a* and 13*b* overlap and tips 13*d* and 13*c* engage each other when two cladding elements 11** are connected, that is, attached side by side.

In addition, the portion of cladding elements 11 with slot 12*a* and leg 13*a* has a disengaging element 16 defining a contact surface 17 so two cladding elements can be simultaneously attached to longitudinal support element 15 of the supporting structure. Contact surface 17 is essentially flat to facilitate this and disengaging element 16 is deep enough to cover the head of screw 14 and regulate the distance between the cladding member and the supporting structure.

Figure 2:
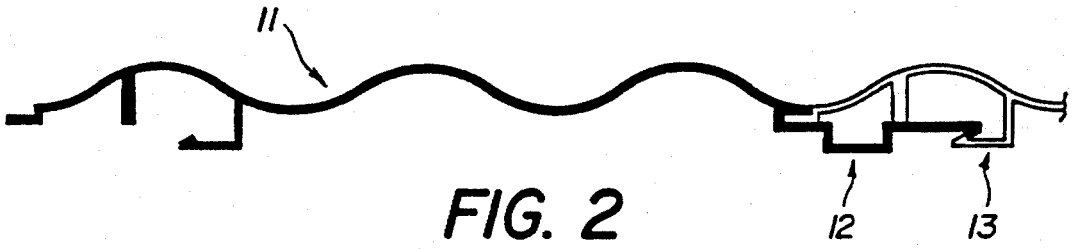
FIGS. 2, 3 and 4 show several variations of cladding members for covering panels according to the invention.
Figure 3:
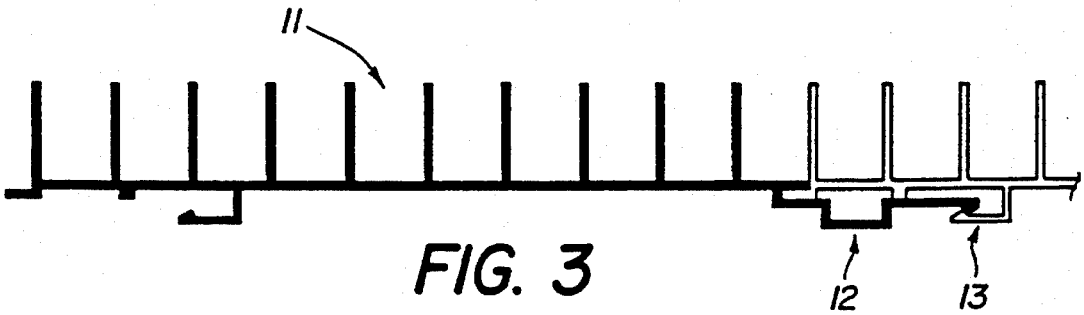
Figure 4:
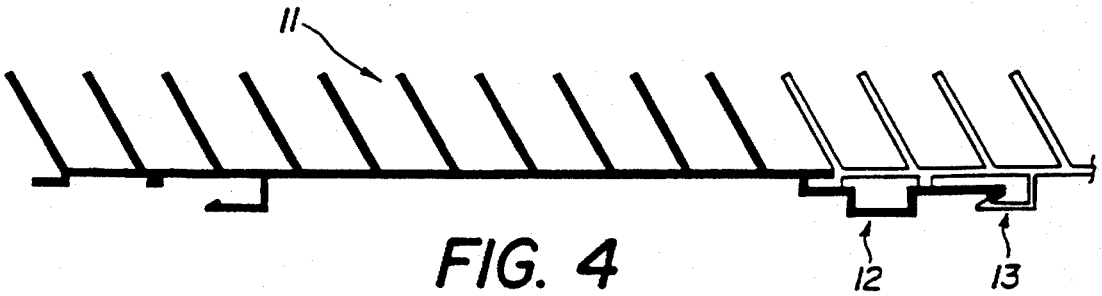

The extrusion technique obviously adapts to many differently shaped elements and any interlocking system similar or identical to those described above. More specifically, FIGS. 2, 3 and 4 show other embodiments of the cladding members which can be made with this technique. As before, the cladding members have a quick assembly means 12 and a locking means 13 on either edge so that after connection, the elements appear to be a continuous unit when the panel is completely attached to a building facade.

Figure 5:
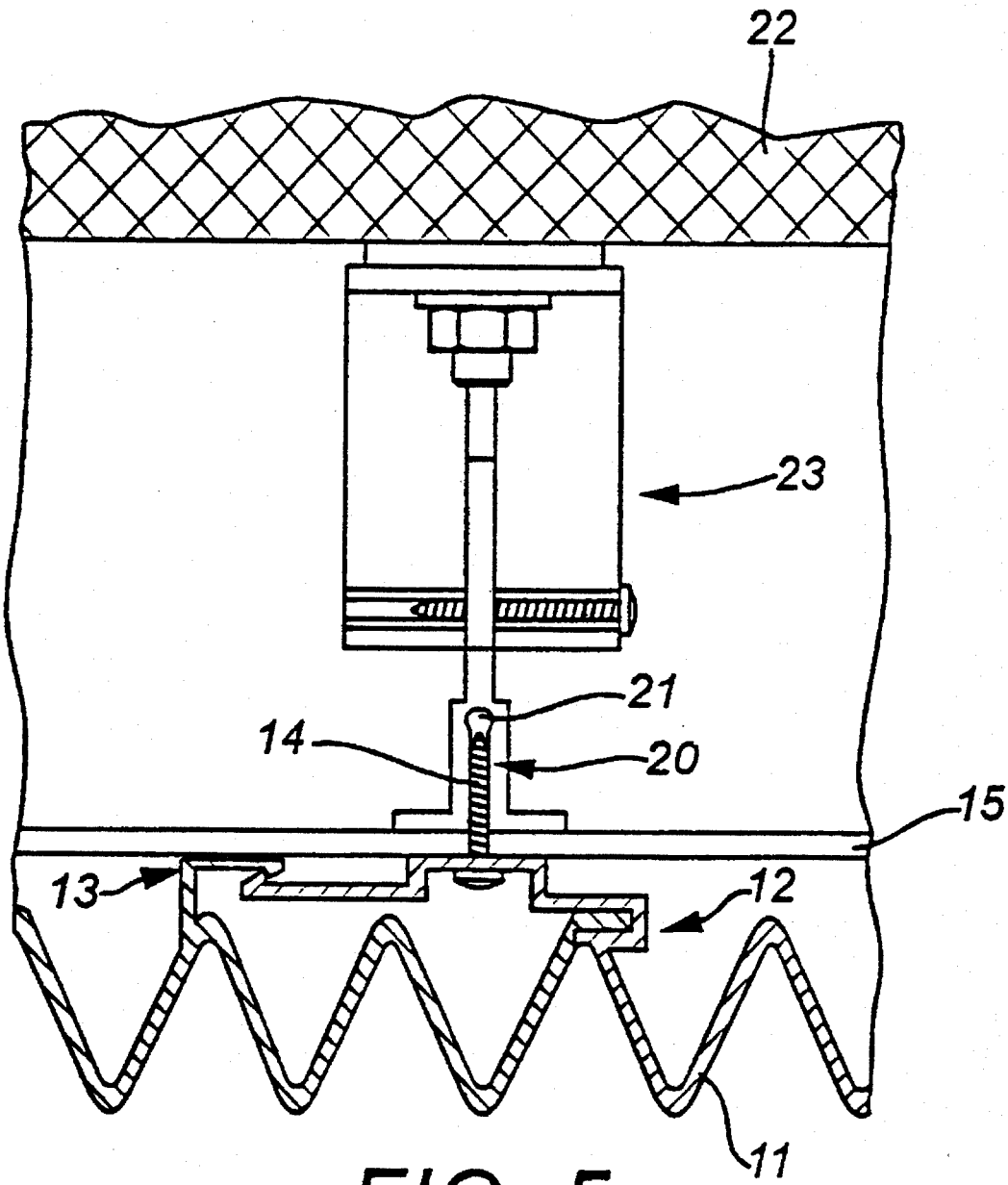
FIG. 5 is a front-to-rear cross-section showing the means for attaching the cladding members to a supporting structure.
Figure 6:
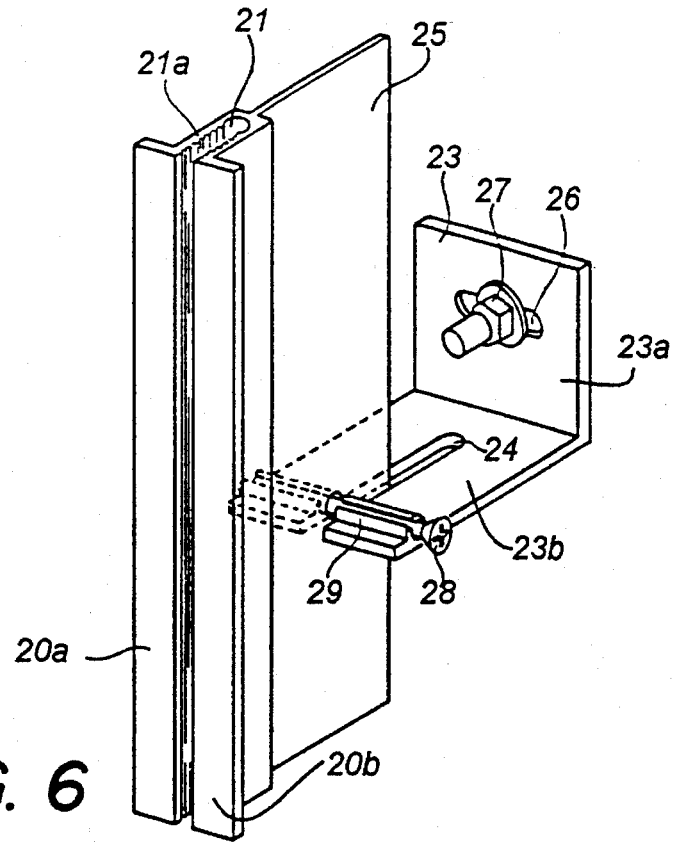
FIG. 6 is a perspective showing the attachment means of FIG. 5.

FIGS. 5 and 6 show in greater detail how the cladding members are attached to the supporting structure. The supporting structure comprises longitudinal sections 20, preferably made of extruded aluminum, with an axial longitudinal channel 21 which receives screws 14 which attach cladding members 11. Longitudinal sections 20 are connected to a masonry wall 22 with brackets 23 which are also made of an extruded aluminum piece formed of sections. Longitudinal sections 20 are generally T-shaped, with the central portion comprising said axial longitudinal channel. This channel has interior walls with grooves 21*a* parallel o its axis, and the distance between these walls, as measured from the base of opposite grooves, is generally equal to the diameter of the shaft of the attachment screw measured around the screw threads, so the screws are held tightly within the groove. The transverse portion of the T splits into two lateral flanges 20*a*, 20*b* located on either side of the channel, respectively. These flanges contact the longitudinal support element 15 to which cladding members 11 will be attached. Note that axial longitudinal channel 21 extends rearwardly only partially along the central portion of the T. The remainder of that portion forms a spline 25 located rearwardly of the extension of the axis of channel 21.

Brackets 23, which form right-angles, have one arm 23*a* and one arm 23*b*, with arm 23*a* designed for attachment to masonry wall 22 and arm 23*b* designed for attachment to longitudinal section 20. For this reason arm 23*a* has an oblong opening 26 for a bolt or an attachment screw 27. The oblong opening regulates the position of bracket 23. Arm 23*b* has a slit 24 which receives spline 25 of the central T-shaped portion of longitudinal section 20. Arm 23*b* is also provided with a generally cylindrical housing 29 spanning its width, which receives blocking screw 28. Cylindrical housing 29 is preferably divided along its entire length. Blocking screw 28 is preferably self-boring and the screw head has blocks to prevent it from loosening due to vibration.

Once the brackets have been placed, longitudinal sections 20 are appropriately positioned. The position of these elements, i.e., the distance from the masonry wall, is defined by how far spline 25 penetrates openings 24 in arms 23*b* of brackets 23. One way to regulate this is by providing an insulating layer and varying the thickness of the layer. Auto-boring blocking screw 28 maintains sections 20 in position.

Complex structures such as the grooves inside channel 21 and housings 29 for blocking screws 28 which maintain longitudinal sections 20 in position can be simply and effectively designed because the elements are manufactured by extrusion.

Figure 7:
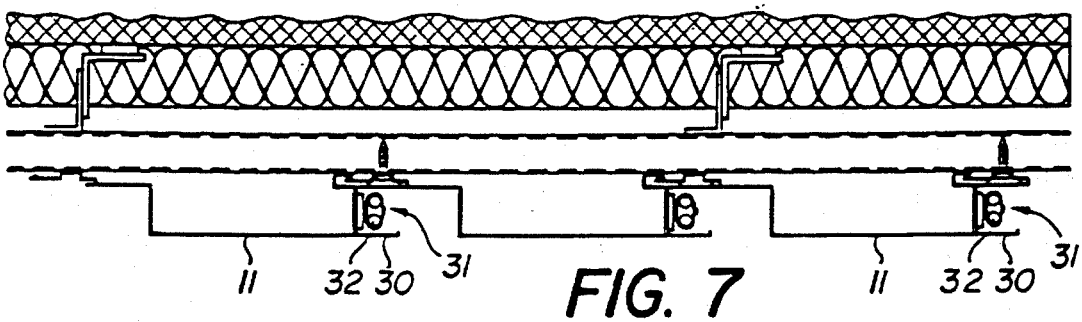
FIGS. 7, 8 and 9 show a specific application of the covering panel according to the invention, wherein the cladding members are designed for the installation of indirect lighting.
Figure 8:
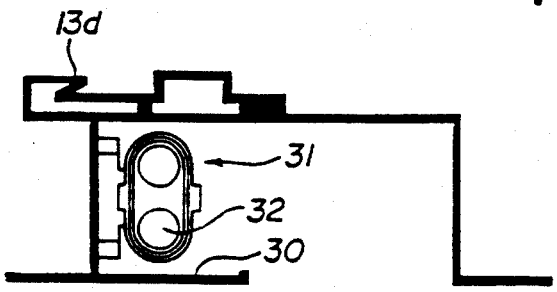
Figure 9:
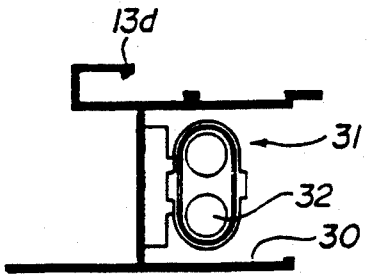

FIGS. 7 through 9 show a particular embodiment for incorporating indirect lighting in the metal cladding. To achieve this, each cladding member 11, the exterior surface of which may be any shape corresponding to the elements shown in FIGS. 1 through 4, comprises a lateral extension 30 which defines an opening 31 for mounting a light 32.

The two enlarged views in FIGS. 8 and 9 show two particular embodiments of the tips of the locking means for cladding elements 11. These elements can be simply and effectively manufactured in any shape by extrusion, whereas conventional manufacturing of such devices would involve complicated, expensive crimping and soldering.

Because all the embodiments of the cladding members have quick assembly and locking features, the number of screws or rivets required to fasten them to the supporting structure is greatly reduced in comparison to the number of attachment means required by systems known in the art.

The present invention is not limited to the embodiments described herein. In particular, the shape of the elements comprising the cladding members can vary. The quick assembly interlocking means and the locking means may be modified. However, both of these functions must take place quasi-simultaneously so the cladding members can be attached quickly, effectively and economically.

The invention claimed is:

1. A facade comprising a plurality of juxtaposed interconnected cladding members (11) wherein the plurality of cladding members (11) comprise a plurality of female cladding members and a plurality of male cladding members, wherein the plurality of juxtaposed interconnected cladding members (11) cover a desired object by connecting the plurality of juxtaposed interconnected cladding members (11) to the desired object by means of a supporting structure, wherein the supporting structure comprises a plurality of support members (20) and a plurality of brackets (23), the plurality of support members (20) having a flanged end and a straight end, the flanged end of the support members (20) including a threaded channel (21*a*), wherein the threaded channel (21*a*) abuts the female cladding member and a screw (14) is inserted with the head of the screw (14) against the female cladding member, the straight end of the female cladding member being held in the bracket (23) where the bracket (23) is fast with the desired object.

2. The facade according to claim 1, wherein the plurality of support members (20) have a front-to-rear cross-section with a generally T-shape, comprising:

a longitudinally extending threaded channel (21*a*) in the flanged end of the support member (20), a pair of transverse flanges at the flanged end of the support member (20), and a longitudinal extension of the straight end of the support member.

3. The facade according to claim 1, comprising a quick assembly means (12), wherein the female cladding panel defines a lateral slot (12*a*) able to accept the male cladding member, and a locking means (13) having a lateral leg (13*a*) with a flexible formed tip (13*d*) used to lock the male cladding member in place, the male cladding panel having a lateral rim (12*b*) securely fitting in the lateral slot (12*a*) of the female cladding member and a lateral leg (13*b*) with a flexible formed tip (13*c*) wherein the flexible formed tip (13*c*) is flexed to underlie and grip the flexible formed tip (13*d*) to lock the plurality of cladding panels (11) into place.

4. The facade according to claim 1, wherein said supporting structure also comprises angled brackets (23), one arm (23*a*) of which has a first opening (26) for a wall attachment screw (27), and the other arm (23*b*) of which has a second opening (24) which receives at least a portion of said spline (25) of said support member (20).

5. The facade according to claim 4, wherein said other arm (23*b*) which has said second opening (24) also has a generally cylindrical longitudinally extending housing (29) spanning its width, perpendicular to said opening, said housing being adapted to receive a blocking screw (28) for said support member (20) when said spline (25) engages said second opening (24).

6. The facade according to claim 5, wherein said blocking screw (28) is self-boring.

7. The facade according to claim 5, wherein said cylindrical housing (29) is divided axially.

8. The facade according to claim 1, wherein the distance between said interior walls of the channel (21), as measured from the base of opposite grooves (21*a*), is generally equal to the diameter of the shaft of the attachment screw (14) measured around the screw threads.

9. The facade according to claim 1, wherein said cladding members (11) comprise housings (31) for concealing lights (32).

10. The facade according to claim 1, wherein said cladding members (11) comprise both quick assembly means (12) and means (13) for locking them in connected position.

11. A cladding panel (11), a plurality of which can be attached longitudinally and laterally to a supporting structure by means of laterally spaced apart, rearwardly-extending screws (14) to provide a facade; said cladding panel (11) comprising:

a) a quick assembly means (12) including, at laterally opposite sides of said cladding panel (11): i) a longitudinally-extending slot (12*a*) with laterally-extending side walls and a lateral opening and ii) a laterally and longitudinally-extending rim (12*b*); said rim (12*b*) being adapted to be laterally inserted into the opening of the slot (12*a*) of a laterally adjacent cladding panel (11) and thereby engage the slot (12*a*) of the adjacent cladding panel; and b) a locking means (13) including, at laterally opposite sides of said cladding panel (11), laterally-extending first and second legs (13*a*, 13*b*) having at their respective lateral ends: i) a rearwardly-extending, first flexible tip (13*d*) and ii) a frontally-extending, second flexible tip (13*c*); said second leg (13*b*) being located rearwardly of said first leg (13*a*) being adapted to: i) frontally overlie the second leg (13*b*) of the adjacent cladding panel (11), and ii) laterally engage the second tip (13*c*) of the second leg (13*b*) of the adjacent cladding panel (11) when said rim (12*b*) is inserted in the slot (12*a*) of the adjacent cladding panel (11) and a screw (14) attaches said cladding panel, between its slot (12*a*) and its first leg (13*a*), to said support member;

c) said slot (12*a*) being located laterally inwardly of said first leg (13*a*) and said first tip (13*d*); said second leg (13*b*) and said second tip (13*c*) being located laterally inwardly of said rim (12*b*); and said tips (13*d*, 13*c*) being located rearwardly of said slot and rim (12*a*, 12*b*).

* * * * *